US006609591B2

(12) United States Patent
Wisniewski

(10) Patent No.: US 6,609,591 B2
(45) Date of Patent: Aug. 26, 2003

(54) SOUNDPROOFING ELEMENT AND SOUNDPROOFING WALL

(75) Inventor: Peter Wisniewski, Eichenzell (DE)

(73) Assignee: Calenberg Ingenieure planmassig elastisch lagern GmbH, Salzhemmendorf (DE)

( * ) Notice: Subject to any disclaimer, the term of this patent is extended or adjusted under 35 U.S.C. 154(b) by 0 days.

(21) Appl. No.: 10/155,737

(22) Filed: May 28, 2002

(65) Prior Publication Data

US 2002/0144861 A1 Oct. 10, 2002

Related U.S. Application Data

(63) Continuation of application No. PCT/EP00/11699, filed on Nov. 24, 2000.

(30) Foreign Application Priority Data

Nov. 25, 1999 (DE) ..... 199 56 669
Dec. 23, 1999 (DE) ..... 199 62 393

(51) Int. Cl.[7] ..... E04B 9/00
(52) U.S. Cl. ..... 181/285
(58) Field of Search ..... 181/285, 284, 181/287, 288, 290, 292, 293, 294

(56) References Cited

U.S. PATENT DOCUMENTS 3,656,576 A * 4/1972 Gubela ..... 181/210
3,667,175 A * 6/1972 Bjorksten ..... 52/144
3,876,034 A * 4/1975 Antonini ..... 181/208
4,214,411 A * 7/1980 Pickett ..... 52/144
4,335,802 A * 6/1982 Kirschner ..... 181/290
4,346,541 A * 8/1982 Schmitt ..... 52/309.11
4,441,581 A * 4/1984 Sommerhalder ..... 181/286
4,838,524 A * 6/1989 McKeown et al. ..... 256/24
4,886,696 A * 12/1989 Bainbridge ..... 428/184
4,969,535 A * 11/1990 Arcas et al. ..... 181/213
6,454,048 B1 * 9/2002 Alts et al. ..... 181/290

FOREIGN PATENT DOCUMENTS

| | | |
|---|---|---|
| DE | 83 09 535.7 | 7/1983 |
| DE | 86 12 223.1 | 8/1986 |
| DE | 39 14 257 | 11/1989 |
| DE | 91 13 416.1 | 1/1992 |
| DE | 40 40 583 | 6/1992 |
| DE | 41 31 394 | 4/1993 |
| DE | 44 22 585 | 10/1995 |
| DE | 295 13 248 | 2/1997 |
| DE | 197 32 904 | 2/1998 |
| DE | 196 52 871 | 1/1999 |
| EP | 0 202 552 | 11/1986 |
| GB | 2 235 942 | 3/1991 |
| GB | 2 305 451 | 4/1997 |

OTHER PUBLICATIONS

XP–002161805, "Textiles Schallschutz–System", Schweizer, Ingenieur und Architeck, Nr. 38, 1984, p. 718.

* cited by examiner

*Primary Examiner*—Shih-yung Hsieh
(74) *Attorney, Agent, or Firm*—Shlesinger, Arkwright & Garvey LLP

(57) ABSTRACT

Soundproofing element includes a first sheet including a flexible material and a second sheet consisting of flexible material. The sheets are positioned at a distance from one another and at least two chambers are formed between said sheets for receiving a filler medium. The first sheet and the second sheet are connected by connection element located on opposing surfaces. Appropriately, the connection elements have at least one connecting length consisting of flexible material. The soundproofing element is constructed simply and robustly. When empty, it is easy to handle and transport. In addition, the inventive soundproofing element is suitable for filling with a high-density filler medium, for example sand or similar material.

57 Claims, 4 Drawing Sheets

SOUNDPROOFING ELEMENT AND SOUNDPROOFING WALL

CROSS REFERENCE TO RELATED APPLICATIONS

This application is a continuation of application no. PCT/EP00/11699, filed Nov. 24, 2000, which claims the priority of both German application no. 199 62 393.7, filed Dec. 23, 1999 and application no. 199 56 669, filed Nov. 25, 1999, and each of which is incorporated herein by reference.

FIELD OF THE INVENTION

The invention relates to a soundproofing element. More particularly, the invention relates to a first sheet of flexible material, and a second sheet of flexible material; the first and second sheets being positioned at a distance from another and connected to each other at the surfaces facing one another by a connector; at least one chamber being formed between the first and second sheets for receiving a filler medium.

BACKGROUND OF THE INVENTION

Soundproofing elements, for instance in the form of soundproofing walls, are generally known, and serve as sound insulation, such as for the insulation of traffic noise, construction noise, or noise in factories.

Soundproofing elements are known from DE 30 04 102 C2 and DE 42 30 786 A1, that are essentially rigidly constructed. Although these soundproofing elements provide very effective soundproofing, their disadvantage, however, is that they are hard to handle due to their large weight.

A soundproofing element is known from DE 196 52 871 C2, that possess a first sheet consisting of flexible material, and a second sheet of flexible material, whereby the sheets are positioned at a distance from one another and at least one chamber is formed between the sheets for receiving a filler medium. In the known soundproofing element, the sheets are constructed in the form of a flexible jacket that can be inflated with air or other gases as the filler medium. One disadvantage of the known soundproofing element is that the sound insulating effect is low due to the gaseous filler medium.

A similar soundproofing element is also known by DE 44 22 585 C1.

A soundproofing material is known from DE 41 31 394 A1 that is essentially rigidly constructed, and possesses two cover layers, between which a core layer is positioned.

Furthermore, a soundproofing material is known from DE 40 40 583 A1 that consists of plastic hollow sections in which, or between which, wastewater sludge is placed.

A soundproofing mat is known from DE 83 09 535 U1 that possesses two layers of plastic foil, between which chambers are constructed for receiving a sound insulating work material.

A soundproofing element of the relevant type is known from the magazine *Schweizer Ingenieur und Architekt* ["Swiss Engineer and Architect,"] 38/1984, page 718, that possesses a first sheet consisting of flexible material, and a second sheet consisting of flexible material, whereby the sheets are positioned at a distance from one another, and whereby the first sheet and the second sheet are connected by connection means located on opposing surfaces. The sheets in the known soundproofing element are constructed of a spacer fabric, the spacer threads or the pole threads of which form the connecting means for the connection of the sheets to one another. The flexible soundproofing wall constructed in this way possesses excellent sound insulating characteristics. However, a disadvantage is that their production is complicated, and therefore expensive. Another disadvantage is that the known soundproofing element can be produced at only a short maximum width.

The invention further relates to a soundproofing wall of the type having a first soundproofing element, and at least a second soundproofing element.

Such a soundproofing wall is known from GB 2 305 451 A. It possesses a first soundproofing element, and at least a second soundproofing element, whereby the first soundproofing element and the second soundproofing element are arranged in neighboring proximity to each other, and whereby additional soundproofing means are intended that span an area in which the first and the second soundproofing elements are in neighboring proximity to each other, by soundproofing it. The additional soundproofing means on the soundproofing wall known from the specification are constructed of cover panels that are connected to a supporting pole of the soundproofing wall by means of screws or rivets. One disadvantage is that this construction is complicated in its production, and therefore expensive, and that the cover panel possesses only a low soundproofing effect.

Similar soundproofing walls are also known from DE 295 13 248 U1, DE 91 13 416.1 U1, DE 197 32 904 A1, and DE 86 12 223 U1.

The invention is based on the task of stating a soundproofing element and a soundproofing wall with simplified production methods, that is therefore constructed less expensive, and with which a high soundproofing effect can be achieved.

This task with regard to the soundproofing elements is solved by the inventive teaching of a first sheet of flexible material, and a second sheet of flexible material; the first and second sheets being positioned at a distance from one another and connected to each other at surfaces facing one another by a connector; at least one chamber being formed between the first and second sheets for receiving a filler medium; the connector possessing at least one connecting length including a flexible material; the connecting length being connected to the first sheet and the second sheet in such a way that a multitude of chambers is formed that are arranged next to each other; and the chambers being separate from each other, and each possessing a lockable fill opening for the filler medium that can be locked, and with regard to the soundproofing wall, by the inventive teaching feature of a soundproofing wall, with a first soundproofing element, and at least a second soundproofing element, whereby the first soundproofing element and the second soundproofing element are arranged in neighboring proximity to each other, and whereby additional soundproofing means are provided that span an area in which the first soundproofing element and the second soundproofing element neighbor each other, as sound insulation, the additional soundproofing means possess an additional soundproofing element according to one of the previous embodiments that can be connected to and detached from the first soundproofing element and the second soundproofing element. The soundproofing wall may be configured so that the additional soundproofing element is friction-lock connected to the first soundproofing element and/or the second soundproofing element.

The invention is based on the knowledge that an excellent soundproofing effect can be achieved by using a filler medium consisting of hard material of high density, such as sand, granulate, or similar.

Accordingly, the invention is based on the idea of connecting the first and the second sheets to one another in such a way that at least two chambers are formed, and an undesired deformation of the soundproofing element is prevented when filling with a filler medium consisting of hard material.

The inventive soundproofing element therefore enables the use of filler media consisting of hard materials that have a substantially higher density and therefore a substantially higher soundproofing effect, than gaseous media. The inventive soundproofing element therefore achieves an excellent soundproofing effect.

The inventive soundproofing element has a low weight in its unfilled state, and is therefore easy to handle. It can therefore be used in various applications, such as a mobile soundproofing element for temporary sound insulation, for instance in the area of construction sites.

After the soundproofing element has been set up, it is filled with the filler medium so that the desired soundproofing effect is achieved.

After use, the filler medium can be removed from the soundproofing element so that the same advantages with regard to easy handling exist in disassembling the soundproofing element, as in the set up.

A safe connection of the first sheet with the second sheet is achieved by means of the connecting length, whereby the weight of the soundproofing element is kept low by essentially omitting rigid connection elements, such as metal. The connecting length can consist of the same material as both the first and the second sheets. However, it may also consist of a different material.

An extremely advantageous further embodiment of the previously mentioned embodiment intends that the connecting length along side the width expansion of the first sheet and the second sheet, or along side the height expansion of the first sheet and the second sheet is successively connected to the first sheet and the second sheet. This results in an even connection along side the width expansion, or the height expansion, respectively, of the sheets, and therefore an even load of the soundproofing element by the filler medium in its filled state. Deformations caused by uneven loads or damages of the soundproofing element are safely avoided in this way.

Purposefully, the connecting length connects the first sheet with the second sheet in the cross section essentially in a zig-zag shape, or a meander shape in the previously mentioned embodiment. In this way, the evenness of the connection of the first sheet with the second sheet is further improved.

The connecting length can generally have any suitable form. For example, the connecting length can extend over a part of the width of the first sheet and/or the second sheet only so that both sheets are connected only across part of their width, which may be sufficient depending on the application. However, it is also possible to intend several connecting lengths in neighboring proximity to each other, or positioned at a distance from one another. Advantageously, however, the connecting length extends across a substantial part of the width of the first and/or the second sheet, preferably substantially across the entire width of the first sheet and/or the second sheet. In this embodiment, the first sheet is connected to the second sheet across a substantial part of the width, or the entire width, respectively, of the sheets. This results in a higher stability of the soundproofing element even when filled with filler media of higher density.

It is generally sufficient if the connecting length extends across a part of the height of the first sheet and/or the second sheet. The stability of the soundproofing element, however, can be further improved if the connecting length extends across a substantial part of the height of the first sheet and/or the second sheet, preferably substantially across the entire height of the first sheet and/or the second sheet, as it is intended in an additional further embodiment.

Purposefully, the connecting length is positioned at a distance from the first sheet and the second sheet from one another, preferably at essentially even distanced connection points to one another.

The connection points can have any suitable form, for instance, pointed. In an advantageous further embodiment the connection points are formed as lines or stripes, and are preferably parallel to each other. A lined or striped connection reliably avoids that the sheets are torn apart from one another, even with the filling with a filler medium of high density.

A further embodiment of the previously mentioned embodiment includes the lined or striped connection points being essentially vertical.

Another embodiment comprises the connecting length being connected to the first sheet and the second sheet in such a way that the chambers are open toward the top. In this embodiment, the filling of the soundproofing element with the filler medium is particularly easy. It is achieved by filling the filler medium into the chambers from the top.

In order to ensure an even distribution of the filler medium into the chambers, the chambers are separated from each other.

Purposefully, the fill openings, however, can be locked by locking means that are connected to, and specially formed onto the soundproofing element.

In the previously mentioned embodiment, the locking means can be configured in any suitable way. A further embodiment intends that the locking means possess at least one cap or latch consisting of flexible material, that can be fixed in its locking position. This embodiment is simple, and can therefore be cost-effectively produced.

A mutual cap or latch can be intended for the locking of at least one fill opening. The embodiment of the soundproofing element is further simplified in this way, and therefore even more cost-effective.

The cap or latch in the previously mentioned embodiment can be fixed in its locking position in any suitable way, for instance by snap fasteners or such. Advantageously, the cap or latch can be fixed in its locking position by means of a velcro fastener, as is intended in the embodiment. This eases the locking of the fill openings.

The filler medium can generally be removed through the fill opening, for instance, by pouring the contents out. Another advantageous further embodiment provides for at least one outlet opening for the filler medium that can be locked at a distance from the input opening. In this embodiment, the removal of the filler medium is made easier.

A mutual output opening can be intended for all chambers in the previously mentioned embodiment. Purposefully, however, one output opening for the filler medium that can be locked is intended for each chamber. The filler medium can separately be removed or discharged from each individual chamber in this embodiment.

According to each requirement, the locking means can be designed in any suitable way for the locking of the output openings. A particularly advantageous further embodiment intends that the, or each output opening can be locked by means of a screw cap. The discharging of the filler medium from the soundproofing element is further simplified in this way.

The flexible material of the first sheet and the second sheet, and the connecting length is selectable in broad ranges according to the individual requirements, whereby the sheets can consist of the same flexible material, or from different materials, such as plastic foil or sheets. According to a particularly advantageous further embodiment, the flexible material of the first sheet and/or the second sheet and/or the connecting length is a fabric, or knitted fabric. Damage to the sheets is avoided due to the fabric or knitted fabric structure, even when filled with filler media of high density, and with frequent use of the soundproofing element. The soundproofing element is especially robust and durable in this way.

It is generally sufficient if the flexible material is uncoated. The characteristics of the soundproofing element, however, can be further improved if the first sheet and/or the second sheet and/or the connecting length possess a one-sided or two-sided coating.

The coating in the previously named embodiment may possess a layer of PVC, as is intended in another further embodiment. The flammability of the soundproofing element is inhibited by the PCV layer. Further, the thermal stability and the UV stability are improved.

In addition to, or instead of the PVC layer, the coating may also possess a layer of a flame resistant material, as is intended in another embodiment. This further improves flame protection.

Purposefully, the coating possesses a varnish coat so that the surface of the soundproofing element is scratch and dirt resistant. Also, this hinders the deposit of dirt and micro-organisms in the sheets. In order to embodiment the soundproofing element optically more attractive, the varnish coat can be printed, for instance with a marketing print. Any varnishes may be used, such as acrylates and fluor polymer systems. Another advantage of the varnish coat is that the weather resistance of the soundproofing element is improved.

The connecting length can be connected with the first sheet and the second sheet in many different ways according to the respective requirements, such as by means of positive riveting. Purposefully, the connecting length, however, is welded or glued to the first sheet and the second sheet. This simplifies the production of the inventive soundproofing element.

With proper sealing of the chamber, or of each chamber of the soundproofing element, a gaseous or fluid medium can be used as the filler medium. Purposefully, the filler medium, however, is a pourable medium. In this way, the filling of the soundproofing element is easy, and an evaporation or leaking of the filler medium is reliably avoided. Especially preferred is a filler medium of high density, which results in a particularly well sound insulating effect.

The filler medium can be for instance sand, granulate, or similar, as is intended in another embodiment. It can also be a mixture of different filler media, such as sand with crushed scrap.

With a respective embodiment of the soundproofing element, and use of a suitable filler medium, the inventive soundproofing element can be designed self-supporting. Particular with the use of filler media of high density, however, it is advantageous that a support construction for the support of the soundproofing element is intended. In this way, large-scale soundproofing elements can be realized even with the use of such filler media.

The support construction of the previously named embodiment can be embodimented in many different ways according to the respective requirements, such as in a frame-type embodiment. A further embodiment intends that the support construction possesses two side supports positioned at a distance to one another. In this type of embodiment, the soundproofing element is attached on the side, thereby resulting in a stable construction.

The stability can be further improved if the support construction possesses a crossbeam that connects the side supports with each other.

The soundproofing element in the previously named embodiments can be attached to the side supports, or to the crossbeam, respectively, in any suitable way, such as by means of hooking them to hooks by means of eyelets, which are attached to the supports, or the crossbeam, respectively. A particularly advantageous embodiment intends that the soundproofing element is connected to the side supports and/or the crossbeam by means of a piping/groove connection. This achieves a form fit between the soundproofing element and the support construction so that the soundproofing element is particularly safely supported.

An extremely advantageous further embodiment of the inventive teaching intends a tension means for tensing of the soundproofing element. This type of embodiment achieves a particularly even distribution of the filler medium due to the tension effect of the tension means, and the risk of undesired deformations of the soundproofing element during filling is further reduced.

The soundproofing element in the previously mentioned embodiment can be tensed in vertical and/or horizontal direction by the tension means.

According to another embodiment, the tension means possess a first part for retaining the soundproofing element at an edge, and a second part for holding the soundproofing element at an edge positioned opposite of the tension direction, whereby the first part and the second part can be adjusted relative to one another for tensing the soundproofing element, and can be fixed in their respective adjusted position. This embodiment is simple in its construction, and can therefore be cost-effectively produced.

A further embodiment of the previously named embodiment intends that the first part is a retaining component that retains the soundproofing element locally fixed at its lower edge, and that the second part is constructed of the cross beam that is adjustable in the tension direction relative to the retaining component, and which retains the soundproofing element at its upper edge. The tensing of the soundproofing element in this embodiment occurs by adjustment of the crossbeam in vertical direction relative to the retaining component.

The adjustment of the crossbeam relative to the retaining component can occur in any suitable way. An advantageous embodiment intends that the respective crossbeam is connected to the side supports by means of a screwing device, particularly by an adjustable screw or a spindle, and can be adjusted relative to the retaining component by means of the screwing devices. This embodiment is constructed simply and robustly.

According to another further embodiment of the inventive teaching, the soundproofing element possesses a sealing element at its lower edge that surrounds and seals the soundproofing element from the bottom. The sealing element reliably prevents moisture from entering the sheets so that the weather resistance of the soundproofing element is further improved.

The sealing element is preferably constructed in the crossbeam in a U-shape, whereby the sealing element is purposefully constructed of a tarp or foil, which is connected to the soundproofing element preferably by gluing or welding. This embodiment is particularly simple, and therefore cost-effectively produced.

However, the sealing element can also be constructed with a coating, as is intended in another embodiment.

The shape and size of the inventive soundproofing element are selectable in additional ranges. The soundproofing element can, for instance, be bent or curved in any way, for example, it can be constructed in circular or half-circular shape in the cross section. It can also be constructed as a soundproofing housing, and completely surround a sound source. For this purpose, the soundproofing element can be constructed, for example, in a cube shape or a dome shape. However, one embodiment intends that the soundproofing element is constructed essentially evenly. In order to insulate a sound source, several inventive soundproofing elements can be grouped next to each other around the sound source in this embodiment, and form a soundproofing wall in this way.

Another further embodiment of the inventive teaching additionally intends that in addition to the first and the second sheets, at least one other sheet is provided, and that the additional sheet is positioned at a distance to the neighboring first or second sheet, and connected to it by connecting means. This results in a multi-shell construction by which the sound insulating effect is further improved. The connecting means can be designed as the connecting means for the connection of the first sheet with the second sheet.

In order to improve the sound insulating effect of the soundproofing element in an area in which the soundproofing element contacts the floor, a purposeful further embodiment intends at least one pocket-shaped receiver for a filler medium, or greenery that is arranged in front of the soundproofing element in an area in which the soundproofing element forms a contact to the floor with its lower edge.

Purposefully, the pocket-shaped receiver is constructed with an opening at the top, and/or consists of a flexible material, as intended in further embodiments.

In order to further improve the sound insulating effect by means of the pocket-shaped receiver, a further embodiment intends that a pocket-shaped receiver each is provided in front of both sides of the soundproofing element, whereby the receivers are connected to one another, and essentially positively surround the soundproofing element at its lower edge.

Advantageous and purposeful further embodiments of the inventive soundproofing wall may include:

the additional soundproofing element is connected to the first soundproofing element and/or the second soundproofing element by means of at least one velcro closure;

the additional soundproofing element is connected to the first soundproofing element and the second soundproofing element by clamping means;

the additional soundproofing element is arranged on the side of the soundproofing wall facing the sound source;

the soundproofing element includes:

a) a first sheet of flexible material, and a second sheet of flexible material;

b) the first and second sheets being positioned at a distance from one another and connected to each other at the surfaces facing one another by a connector;

c) at least one chamber being formed between the first and second sheets for receiving a filler medium;

d) the connector possessing at least one connecting length including a flexible material;

e) the connecting length being connected to the first sheet and the second sheet in such a way that a multitude of chambers is formed that are arranged next to each other; and f) the chambers being separate from each other, and each possessing a lockable fill opening for the filler medium that can be locked.

the fill openings can be locked by locking means that are connected, particularly attached to the soundproofing element.

The invention is further explained in the attached, strongly schematic illustration, which includes an example.

BRIEF DESCRIPTION OF THE DRAWINGS

It shows.

DETAILED DESCRIPTION OF THE INVENTION

Figure 1:
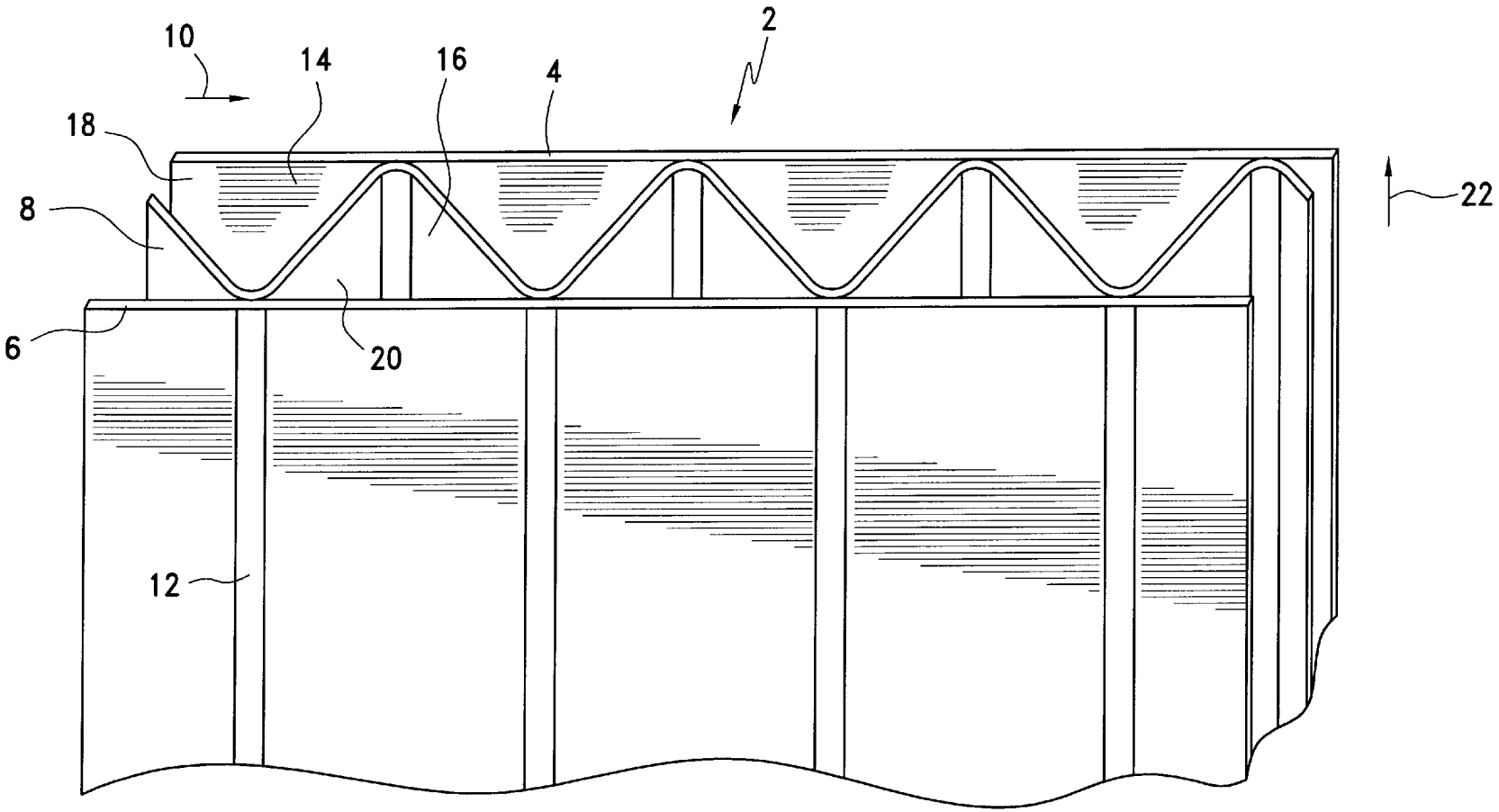
FIG. 1 a section of an inventive soundproofing element in schematic perspective view consisting of a first sheet and a second sheet that are positioned at a distance from one another and are connected to each other by means of a connecting length.

FIG. 1 shows a soundproofing element possessing a first sheet 4, and a second sheet 6 consisting of a flexible material, which are positioned at a distance from one another and are connected to each other at surfaces facing each other by connecting means, which are constructed of a connecting sheet 8 consisting of flexible material in this embodiment.

In this embodiment, the flexible material of the sheets 4, 6, 8 consists of a polyester fabric that possesses a two-sided coating. The coating possesses a layer of PVC which inhibits flammability and improves the thermal stability and UV stability of the sheets 4, 6, 8. The surface of the coating possesses a varnish layer consisting of a fluor polymer, which makes the surface of the soundproofing element 2 scratch and dirt resistant, and which prevents a deposit of dirt and microorganisms. The surfaces of the sheets 4, 6 facing away from one another may have a print.

Alongside of the width expansion of the first sheet and of the second sheet, i.e., in FIG. 1 in the direction of the arrow 10, the connecting length 8 is successively connected with the first sheet 4 and the second sheet 6 in such a way that the connecting length 8 connects the first sheet 4 with the second sheet 6 essentially in a zig-zag, or meander shape. The connection of the connecting length 8 with the first sheet 4 and the second sheet 6 is achieved by welding of stripe-shaped, essentially vertically running connection points, of which only one connection point is referenced by the number 12 in the drawing.

The zig-zag, or meander shaped connection of the connecting length 8 of the first sheet 4 and the second sheet 6 forms a multitude of chambers of essentially the same volume, that are arranged next to each other, and are open at the top, of which only two chambers with the reference numbers 14, 16 are shown in the drawing, which can be filled with the filler medium at the fill openings 18, 20 attached at their upper ends. The filler medium in this embodiment is sand, which results in a particularly good sound insulating effect.

As the drawing does not clearly show it, it is explained in further detail hear that the connecting sheet 8 expands essentially across the entire height, i.e., in the direction of the arrow 2 in FIG. 1, as well as essentially across the entire width, i.e., in direction of the arrow 10 in FIG. 1, of the first sheet 4 and the second sheet 6. In this way, an essentially eve connection of the sheets 4, 6 is achieved across the entire height and the entire width of the first sheet 4 and the second sheet 6. The soundproofing element 2, that is flexibly designed in the embodiment, therefore possesses a high stability so that damages of the connecting points 12 are reliably prevented with the filling of filler media even of high density. Furthermore, this results in an even distribution of the filler medium in the soundproofing element 2 in its filled state.

Figure 2:
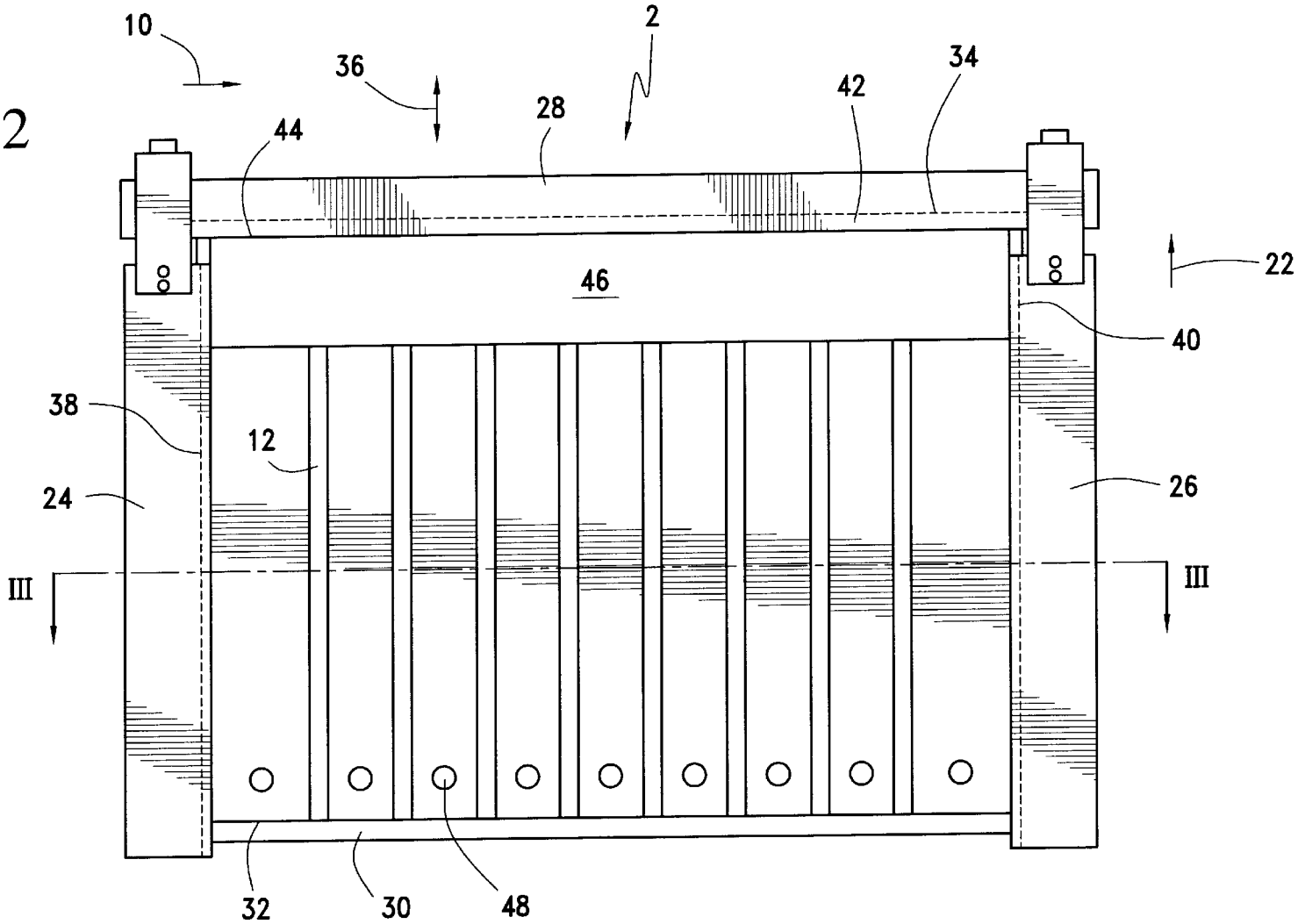
FIG. 2 a schematic front view of the soundproofing element according to FIG. 1 that is retained by means of a support construction.

FIG. 2 shows a front view of the soundproofing element 2 possessing a support construction in this embodiment that consists of two side supports 24, 26, and a crossbeam 28, which connects the supports 24, 26 with each other. Additionally, the support construction in this embodiment possesses a retaining component 30 that is firmly connected to the side supports 24, 26, and that locally retains the soundproofing element 2 at its upper edge, and is vertically adjustable relative to the retaining component 30 in the direction of the double arrow 36 (of FIG. 2) as explain in detail in FIG. 4, and can be fixed in its respective adjustment in a way further explained by FIG. 4, and thereby forms a tensioning means for tensing the sheets 4, 6, 8 that are connected to each other. As described in more detail below in connection with FIG. 4, crossbeam 28 can move up and down, thus vertically tensioning the sheets. Horizontal tensioning is inherent to a degree, as will be readily understood, and analogous vertical and/or horizontal tensioning elements can be provided as will be readily apparent.

The soundproofing element 2 possesses piping flanges 38, 40, 42 at its sides and at its upper edge that positively engage in complementary formed grooves in the supports 24, 26, or the crossbeam 28 so that the soundproofing element 2 is safely connected to the support construction via a piping/groove connection.

As FIG. 2 shows, the stripe-shaped connection points 12 extend essentially across the entire height of the sheets 4, 6 in such a way that the connecting length 8 connects the sheets 4, 6 essentially across the entire height of the sheets 4, 6.

The soundproofing element 2 possesses a locking means in the area of the fill openings 18, 20, which is constructed of a flap 46 that can be folded out that is connected to the second sheet 6, and is attached at its upper edge 44, and as shown in FIG. 2 can be folded out from the drawing level, which closes the fill openings facing the viewer in FIG. 2 of the chambers 14, 16 positioned next to each other, as well as the additional chambers. In the locking positioned illustrated in FIG. 2, the flap 46 can be attached to the second sheet 6 by means of a not illustrated velcro closure.

In the area of their lower ends, the chambers possess outlet openings for the filler medium, that can be locked by means of screw caps in this embodiment, of which only one screw cap in FIG. 2 is referenced with the number 48.

Figure 3:
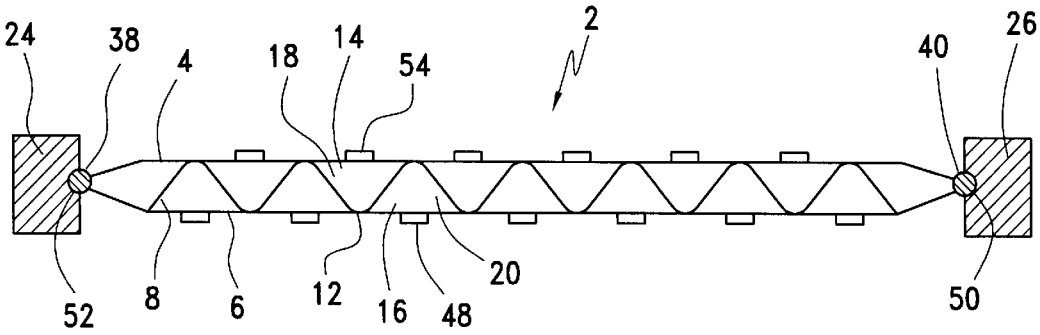
FIG. 3 a schematic section along a line III—III in FIG. 2.

FIG. 3 shows a section across a line III—III in FIG. 2. It shows that the piping flanges 38, 40 of the sheets 4, 6, 8 that are connected to each other, engage into complementary formed grooves 52, 50 of the side supports 24, 26. The side supports 24, 26 in this embodiment are constructed of full profile components. However, they may also be constructed of hollow profile components.

FIG. 3 also show that the connecting length extends essentially across the entire width of the sheets 4, 6, and connects them in a or meander shape to each other. The chambers facing away from the viewer in FIG. 2, such as chamber 14, also possess outlet openings that are locked by means of screw caps, of which only one screw cap is referenced with the number 48 in FIG. 3.

Figure 4:
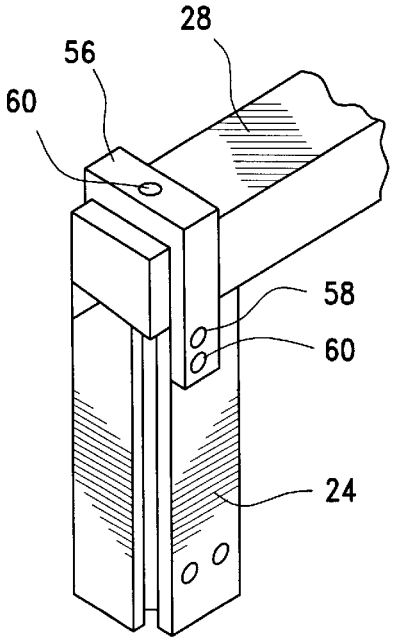
FIG. 4 a single unit of one of the side supports with the crossbeam of the support construction in the area of the connection in schematic perspective view.

FIG. 4 shows a perspective illustration of a detail in the area of the connection of the crossbeam 28 with the side support 24. The support 24 possesses a U-shaped pin 56 that is attached to the support 24 by means of push bolts 58, 60.

The functionality of the inventive soundproofing element 2 is as follows:

The soundproofing element 2 possesses a low weight in its empty state so that it can be easily transport and handled. The soundproofing element 2 is respectively positioned in the area of the sound source for insulating the sound. Then the chambers 14, 16, as well as the additional chambers, are filled with sand as the filler medium by means of the assigned fill openings 18, 20. In order to avoid a gathering of the filler medium in the lower area of the chambers, the soundproofing element is first tensed by means of a vertical adjustment of the crossbeam 28 in vertical direction. In this way, a "sagging" of the sand, and an undesired gathering in the lower area of the chambers 14, 16 is avoided. By way of the even distribution of the sand in the chambers 14, 16 achieved in this way, an essentially even sound insulating effect is achieved across the entire surface of the essentially evenly constructed soundproofing element 2. Additionally, this results in an even load on the connecting points 12 so that a damage of the soundproofing element 2 is avoided in these areas.

After the filling of the chambers 14, 16, and the additional chambers with sand, the fill openings 18, 20, and the additional fill openings are locked by means of the flap 46, and the flap 46 is fixed in its locking position by means of velcro closures. This reliably avoids penetration of moisture into the chambers 14, 16.

The inventive soundproofing element 2 exhibits a particularly good sound insulating effect owing to the filler medium of high density.

After use of the soundproofing element 2, the sand can be discharged by opening the screw caps 48, 54, and the additional screw caps. The soundproofing element 2 can again be easily handled and transported away.

Figure 5:
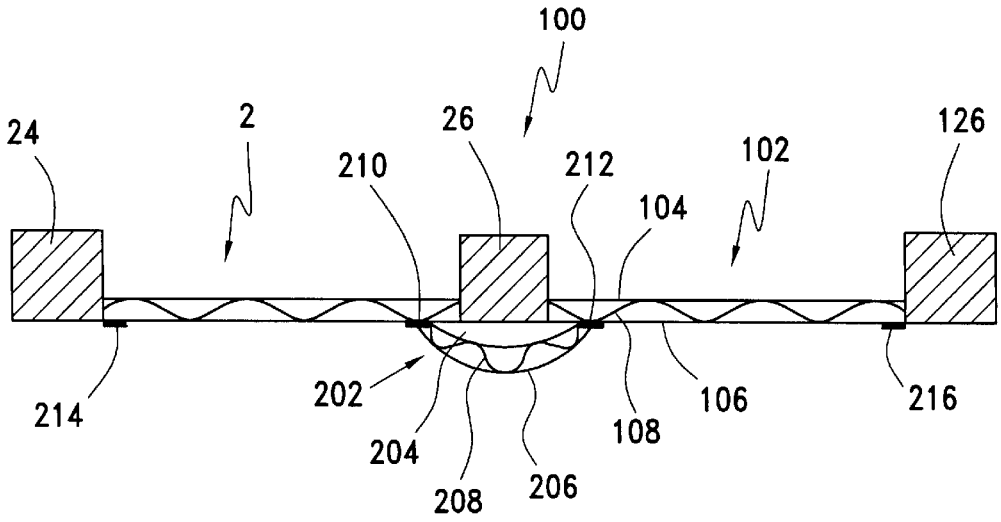
FIG. 5 a horizontal section in a strongly schematic illustration through a soundproofing wall consisting of inventive soundproofing elements that are arranged in neighboring proximity to one another, whereby additional soundproofing means are constructed of an additional soundproofing element.

FIG. 5 shows a horizontal section across a soundproofing wall, generally identified by 100, which consists of the soundproofing element 2 according to FIGS. 1 to 4, as well as an additional soundproofing element 102. The soundproofing element 102 is constructed as has been described in FIGS. 1–4 for the soundproofing element 2. The soundproofing elements 2, 102 are arranged in neighboring proximity, and bordering each other, whereby the soundproofing element 102 possesses sheets 104, 106, 108 that are connected to each other, which are retained at their sides facing the soundproofing element 2 at the support 26, and at their sides facing away from the soundproofing element 2 at a support 126.

The soundproofing elements 2, 102 possess connection means in the areas of their edges for the connection with additional soundproofing means, which are constructed of an additional soundproofing element 202 in this embodiment. The additional soundproofing element 202 is constructed in a corresponding way to the soundproofing elements 2, 102, and possesses sheets 204, 206 that are connected to each other by a connecting length 208. The chambers formed in the soundproofing elements 2, 102, and the additional soundproofing element 202 are filled with a filler medium when the soundproofing wall 100 is in use, such as with water.

The connection means for the connection of the soundproofing elements 2, 102 with the additional soundproofing element 202 are constructed with VELCRO® (e.g., hook-and-loop fastener) closures in this embodiment, which are arranged at 210, 212. By means of the velcro closures, that run across the entire height of the soundproofing elements 2, 102, the additional soundproofing element 202 can be connected to the soundproofing elements 2, 102 by friction-locked and detachable closure. It extends across the entire height of the soundproofing elements 2, 102, and, as FIG. 5 shows, completely spans across the area in which the soundproofing elements 2, 102 are neighboring each other. This avoids the formation of a sound bridge in the area of the support 26 so that the soundproofing wall 100 as a whole possesses a high insulating effect.

In a corresponding way, additional VELCRO® (e.g., hook-and-loop fastener) closure components 214, 216 can be arranged in the area of the edges of the soundproofing elements 2, 102, in order to further increase the soundproofing wall 100 by adding additional soundproofing elements, and in order to add additional soundproofing means to those areas in which neighboring soundproofing elements are arranged respectively, such as in the form of additional soundproofing elements 202.

Figure 6:
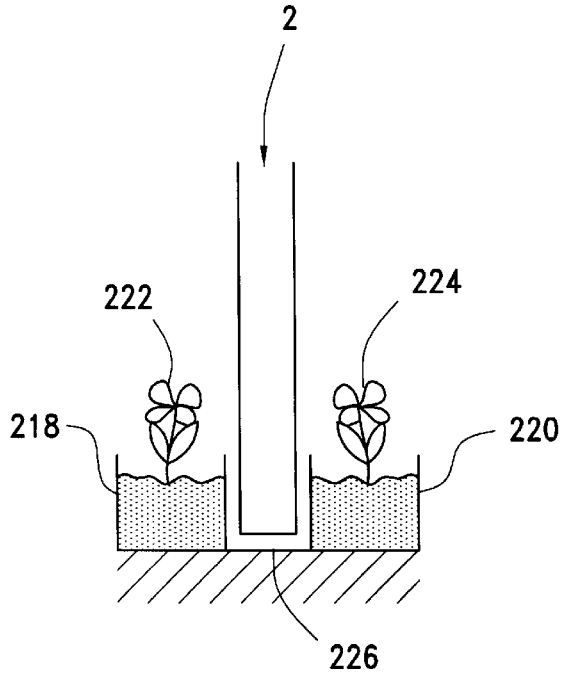
FIG. 6 a vertical section in a strongly schematic illustration through an additional example of an inventive soundproofing element with the additional soundproofing means being constructed of pocket-shaped receivers.

FIG. 6 shows a vertical section across an additional embodiment of an inventive soundproofing element 2. In this embodiment, the additional soundproofing means are constructed of two pocket-shaped receivers 218, 220 that are open at the top, that are intended for holding greenery 222, 224. The pocket-shaped receivers 218, 220 are connected to one another by means of a material length 226, and essentially positively surround the soundproofing element 2 at its lower edge, as illustrated in FIG. 6. In this way, the additional soundproofing elements formed by the pocket-shaped receivers 218, 220 reach into an area in which the soundproofing element 2 contacts the floor at its lower edge. This avoids the formation of a sound bridge in this area, and improves the sound insulating effect.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Soundproofing element, comprising:

a) a of flexible material, and a second sheet of flexible material;

b) the first and second sheets being positioned at a distance from one another and connected to each other at surfaces facing one another by a connector;

c) at least one chamber being formed between the first and second sheets for receiving a filler medium;

d) the connector possessing at least one connecting sheet including flexible material;

e) the connecting sheet being connected to the first sheet and the second sheet in such a way that a multitude of chambers is formed that are arranged next to each other; and f) the chambers being separate from each other, and each possessing a closable fill opening for the filler medium; and g) at least one locking element being provided, the at least one locking element being configured for locking at least one closable fill opening.

2. Soundproofing element according to claim 1, wherein:

a) the connecting sheet is successively connected to the first sheet and the second sheet alongside the width expansion of the first sheet and the second sheet, or alongside the height expansion ion of the first sheet and the second sheet.

3. Soundproofing element according to claim 1, wherein:

a) the connecting sheet connects the first sheet with the second sheet in a cross section in an essentially zig-zag or meander shape.

4. Soundproofing element according to claim 1, wherein:

(a) the connecting sheet length extends across a substantial part of the width of the first sheet.

5. Soundproofing element according to claim 1, wherein:

a) the connecting sheet extends across a substantial part of the height of the first sheet and/or the second sheet.

6. Soundproofing element according to claim 1, wherein:

a) the connecting sheet is connected to the first sheet and the second sheet at connection points that are positioned at a distance from one another.

7. Soundproofing element according to claim 6, wherein:

a) the connection points are formed as lines or stripes.

8. Soundproofing element according to claim 7, wherein:

a) the line or stripe-shaped connection points substantially run vertically.

9. Soundproofing element according to claim 1, wherein:

a) the chambers are open at the top.

10. Soundproofing element according to claim 1 wherein:

a) the at least one locking elements possesses at least one flap or fishplate including a flexible material, which can be fixed in its locking position.

11. Soundproofing element according to claim 10, wherein:

a) a mutual flap or fishplate is included for locking at least some of the fill openings.

12. Soundproofing element according to claim 10, wherein:

a) the flap or fishplate is fixed in its locking position by a ok-and-loop closure.

13. Soundproofing element according to claim 1, wherein:

a) at least one lockable discharge opening is provided for the filler medium.

14. Soundproofing element according to claim 13, wherein:

a) the at least one, discharge opening is lockable by a screw cap.

15. Soundproofing element according to claim 1, wherein:

a) each of the at least one chambers possesses a lockable discharge opening for the filler medium.

16. Soundproofing element according to claim 1, wherein:

a) the flexible material of the first sheet and/or of the second sheet and/or of the connecting sheet is a fabric or a knitted fabric.

17. Soundproofing element according to claim 1, wherein:

a) at least one of the first sheet, the second sheet, and the connecting sheet includes at least a one-layer coating.

18. Soundproofing element according to claim 17, wherein:

a) the at least one-layer coating includes a PVC layer.

19. Soundproofing element according to claim 17, wherein:

a) the at least one-layer coating possesses a layer of a flame resistant material.

20. Soundproofing element according to claim 17, wherein:

a) the at least one-layer coating possesses a varnish layer on its surface.

21. Soundproofing element according to claim 1, wherein:

a) the connecting sheet is welded and/or glued to the first sheet and the second sheet.

22. Soundproofing element according to claim 1, wherein:

a) the filler medium is a pourable medium.

23. Soundproofing element according to claim 22, wherein:

a) the filler medium includes one of sand and granulate.

24. Soundproofing element according to claim 1, wherein:

a) a support construction is provided for the support of the sheets that are connected to each other.

25. Soundproofing element according to claim 24, wherein:

a) the support construction possesses two side supports that are positioned at a distance from each other.

26. Soundproofing element according to claim 24, wherein:

a) the support construction possesses a crossbeam that connects the side supports with each other.

27. Soundproofing element according to claim 26, wherein:

a) the soundproofing element is connected to the side supports and/or the crossbeam by a piping/groove connection.

28. Soundproofing element according to claim 1, wherein:

a) a tension element is provided for tensioning the soundproof element.

29. Soundproofing element according to claim 28, wherein:

a) the soundproofing element is tensioned by the tension element in at least a vertical direction.

30. Soundproofing element according to claim 28, wherein:

a) the tension element includes a first component for retaining the soundproofing element at an edge, and a second component for retaining the soundproofing element at an edge in an opposite direction of a tension direction, whereby the first component and the second component are adjustable relative to each other for tensioning of the sheets, and are fixable be in their respective adjustment positions.

31. Soundproofing element according to claim 1, wherein:

a) the soundproofing element possesses a sealing element at its lower edge, which surrounds the soundproofing element as a seal from the bottom.

32. Soundproofing element according to claim 31, wherein:

a) the sealing element is substantially U-shaped in cross section.

33. Soundproofing element according to claim 1, wherein:

a) the soundproofing element is formed essentially evenly.

34. Soundproofing element according to claim 1, wherein:

a) at least one additional sheet is provided, and the additional sheet is positioned at a distance from the first sheet or the second sheet, and is connected to it by a connection element.

35. Soundproofing element according to claim 1, wherein:

a) at least one pocket-shaped receiver is provided for a filler medium or greenery that is arranged in front of the soundproofing element in an area in which the soundproofing element contacts a floor with its lower edge.

36. Soundproofing element according to claim 35, wherein:

a) the at least one, pocket-shaped receiver is open at the top.

37. Soundproofing element according to claim 35, wherein:

a) the at least one, pocket-shaped receiver includes flexible material.

38. Soundproofing element according to claim 35, wherein:

a) the at least one pocket-shaped receiver includes pocket-shaped receivers provided on each side and in front of the soundproofing element, whereby the receivers are connected to each other and substantially surround the soundproofing element at its lower edge.

39. Soundproofing wall, comprising:

a) a first soundproofing element, and at least a second soundproofing element;

b) the first soundproofing element and the second soundproofing element bring arranged in neighboring proximity to each other;

c) addition soundproofing element being provided that spans an area in which the first soundproofing element and the second soundproof in element neighbor each other as sound insulation;

d) the additional soundproofing elements being connectable to and detachable from the first soundproofing element and the second soundproofing element.

40. Soundproofing wall according to claim 39, wherein:

a) the connecting length is successively connected to the first sheet and the second sheet alongside the width expansion of the first sheet and the second sheet, or alongside the height expansion of the first sheet and the second sheet.

41. Soundproofing wall according to claim 39, wherein:

a) the additional soundproofing element is friction-lock connected to the first soundproofing element and/or the second soundproofing element.

42. Soundproofing wall according to claim 39, wherein:

a) the additional soundproofing element is connected to the first soundproofing element and/or the second soundproofing element by at least one hook-and-loop closure.

43. Soundproofing wall according to claim 39, wherein:

a) the additional soundproofing element is connected to the first soundproofing element and the second soundproofing element by a clamping element.

44. Soundproofing wall according to claim 39, wherein:

a) the additional soundproofing element is arranged on the side of the soundproofing wall facing the sound source.

45. Soundproofing element, comprising:

a) a first sheet of flexible material, and a second sheet of flexible material;

b) the first and second sheets being positioned at a distance from one another and connected to each other at surfaces facing one another by a connector;

c) chambers being formed between the first and second sheets for receiving a filler medium;

d) the connector possessing at least one connecting length including a flexible material;

e) the connecting length being connected to the first sheet and the second sheet in such a way that a multitude of the chambers is formed that are arranged next to each other;

f) the multitude of chambers being separate from each other, and each possessing a lockable fill opening for the filler medium that is lockable; and g) the multitude of chambers being open at the top.

46. Soundproofing element according to claim 45, wherein:

a) the fill opening are lockable by a locking element attached to the soundproofing element.

47. Soundproofing element according to claim 45, wherein:

a) one of a flap or fishplate is fixable in its locking position by a hook-and-loop closure.

48. Soundproofing element, comprising:

a) a first sheet of flexible material, and a second sheet of flexible material;

b) the first and second sheets being positioned at a distance from one another and connected to each other at surfaces facing one another by a connector;

c) at least one chamber being formed between the first and second sheets for receiving a filler medium;

d) the connector possessing at least one connecting sheet including a flexible material;

e) the at least one connecting sheet being connected to the first sheet and the second sheet in such a way that a multitude of chambers is formed that are arranged next to each other;

f) the chamfers being separate from each other, and each possessing a closable fill opening for the filler medium; and g) at least one lockable discharge opening being provided for the filler medium.

49. Soundproofing element according to claim 48, wherein:

a) each of the multitude of chambers possesses a lockable discharge opening for the filler medium.

50. Soundproofing element according to claim 48, wherein:

a) the at least one discharge opening is lockable by a screw cap.

51. Soundproofing element, comprising:

a) a first sheet of flexible material, and a second sheet of flexible materials;

b) the first and second sheets being positioned at a distance from one another and connected to each other at surface facing one another by a connector;

c) at least one chamber being formed between the first and second sheets for receiving a filler medium;

d) the connector possessing at least one connecting sheet including a flexible material;

e) the at least past one connecting sheet being connected to the first sheet and the second sheet in such a way that a multitude of chambers is formed that are arranged next to each other;

f) the chambers being separate from each other, and each possessing a closable le fill opening for the filler medium;

g) a tension element being provided for tensioning the soundproofing element;

h) the tension element including a first component for retaining the soundproofing element at an edge, and a second component for retaining the soundproofing element at an edge in an opposite direction of a tension direction, whereby the first component and the second component are adjustable relative to each other for tensioning of the sheets, and are fixable in their respective adjustment positions; and i) the first component being a retaining component that locally retains the soundproofing element at its lower edge, and the second component being formed by a crossbeam that can be adjusted in a tension detection relative to the retaining component and the soundproofing element at its upper edge.

52. Soundproofing element according to claim 51, wherein:

a) the crossbeam is respectively connected to the side supports by a screwing device, and can be adjusted relative to the retaining component by the screwing devices.

53. Soundproofing element, comprising:

a) a first sheet of flexible material, and a second sheet of flexible material;

b) the first and second sheets being positioned at a distance from one another and connected to each other at surfaces facing one another by a connector;

c) at least one chamber being formed between the first and second sheets for receiving a filler medium;

d) the connector possessing at least one connecting sheet including a flexible material;

e) the at least one connecting sheet being connected to the first sheet and the second sheet in such a way that a multitude of chambers is formed that are arranged next to each other;

f) the chambers being separated from each other, and each possessing a closable fill opening for the filler medium;

g) the soundproofing element possessing a sealing element at its lower edge, which surrounds the soundproofing element as a seal from the bottom; and h) the sealing element including a tarp or foil connected to the sheets.

54. Soundproofing element according to claim 53, wherein:

a) the sealing element possesses a coating.

55. Soundproofing element, comprising:

a) a first sheet of flexible material, and a second sheet of flexible material;

b) the first and second sheets being positioned at a distance from one another and connected to each other at surfaces facing one another by a connector;

c) at least one chamber being formed between the first and second sheets for receiving a filler medium;

d) the at least one connector possessing at least one connecting sheet including a flexible material;

e) the connecting sheet being connected to the first sheet and the second sheet in such a way that a multitude of chambers is formed that are arranged next to each other;

f) the chambers being separated from each other, and each possessing a closable fill opening for the filler medium; and g) a connection element being provided for the connection of the soundproofing element with additional soundproofing elements, which in the formation of a soundproofing wall includes several soundproofing elements spanning an area in which the soundproofing element borders a neighboring soundproofing element, as sound insulation.

56. Soundproofing element according to claim 55, wherein:

a) the connection element in the formation of a soundproofing wall is arranged in the area of an edge of the soundproofing element neighboring the bordering soundproofing element.

57. Soundproofing element according to claim 55, wherein:

a) the connection element includes at least a part of a hook-and-loop closure.

* * * * *